United States Patent [19]

Ikenberry

[11] 3,945,756

[45] Mar. 23, 1976

[54] CENTRIFUGAL PUMPING SYSTEM

[76] Inventor: Paul F. Ikenberry, 15943 Vera Court, Oak Forest, Ill. 60452

[22] Filed: Nov. 14, 1973

[21] Appl. No.: 415,509

[52] U.S. Cl. ..... 415/66; 417/390; 60/325

[51] Int. Cl.[2] ..... F04D 13/04; F04D 17/08

[58] Field of Search ..... 415/147, 199 A, 219 C, 415/61, 62, 64, 68, 66; 417/390; 60/325, 330, 337

[56] References Cited

UNITED STATES PATENTS

| | | | |
|---|---|---|---|
| 106,348 | 8/1870 | Ericsson | 415/199 A |
| 557,300 | 3/1896 | Barber | 415/219 C |
| 921,118 | 5/1909 | Kasley | 415/147 |
| 2,321,276 | 6/1943 | DeBolt | 415/147 |

FOREIGN PATENTS OR APPLICATIONS

| | | | |
|---|---|---|---|
| 28,573 | 3/1903 | Switzerland | 415/199 A |
| 105,930 | 3/1927 | Austria | 415/199 A |
| 39,126 | 10/1909 | Austria | 415/147 |
| 66,352 | 2/1948 | Denmark | 415/147 |
| 931,344 | 10/1947 | France | 415/147 |

*Primary Examiner*—Henry F. Raduazo
*Attorney, Agent, or Firm*—Edward E. Dyson; John J. Byrne

[57] ABSTRACT

Disclosed is a centrifugal pump having a housing, an input and an output port, and a driven impeller. Surrounding the impeller is a turbine means which serves to retrieve at least part of the kinetic energy imparted by the impeller to the pumping medium. The energy retrieved by the turbine means can be used to apply additional power to a prior auxiliary stage, an after auxiliary stage, or back to the original impeller itself. In this manner, the turbine retrieves kinetic energy which might otherwise be wasted and, therefore, the turbine improves the overall efficiency of the pump. Stationary flanges at the discharge end of the pump jacket serve to convert the remaining curvilinear motion of the water column into a non-revolving column of water. The stationary flanges also help to avoid a drop in the operating pressure at the discharge end of the jacket.

8 Claims, 11 Drawing Figures

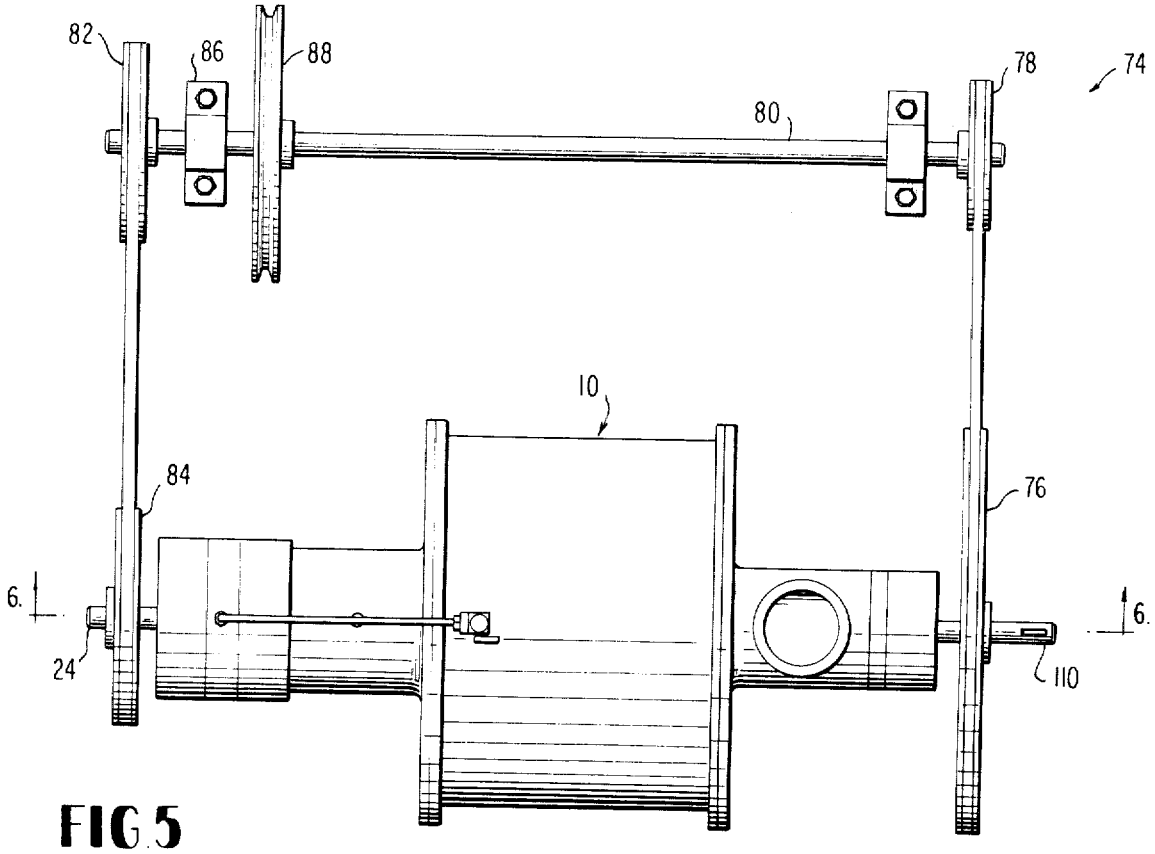
FIG. 5
FIG. 7
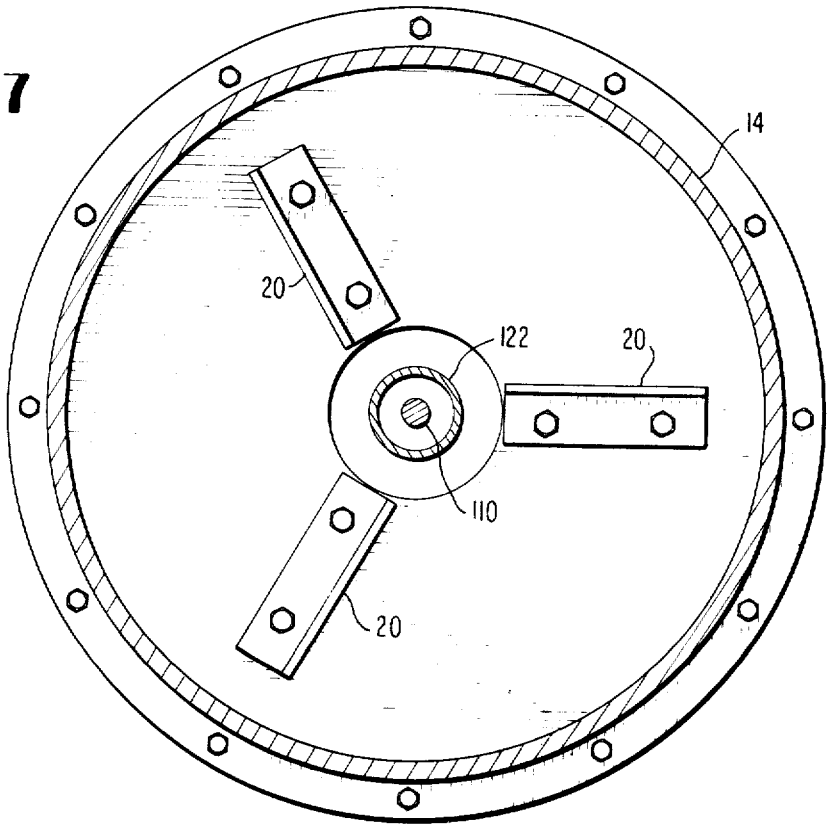

CENTRIFUGAL PUMPING SYSTEM

BACKGROUND OF THE INVENTION

1. Field of the Invention

This invention relates generally to centrifugal pumps and, more particularly, to a centrifugal pump in which at least part of the kinetic energy produced by the impeller is retrieved by a turbine section.

2. Description of the Prior Art

Typical prior art centrifugal pumps include impellers which are constructed with curved vanes and which discharge into a volute chamber. The tangential motion produced by the impeller is necessarily directed against the head. It is the opinion of the inventor that the belief that centrifugal force cannot be used off the circle after pumping begins, led to the evolution of the present conventional centrifugal pump. However, basic principles of curvilinear motion have been englected or overlooked. Directing the tangential motion from an impeller against the head negates the ability to utilize curvilinear motion in a pumping system, where the head is the source of the centripetal force and centrifugal force is used to oppose the head. In this system the kinetic energy of the water revolving in the jacket must be recovered by some means or wasted as heat, as it has been previously shown that all curvilinear motion must be destroyed before the water leaves the jacket. The instant invention, including a novel turbine, retrieves at least some of the incidential kinetic energy and converts it into useful energy that may be used to drive either an auxiliary stage or improve the performace of the impeller itself. In general, it is known in the prior art to drive one rotor with another rotor. See, for example, Hornschuch U.S. Pat. No. 2,349,731; Jones U.S. Pat. No. 1,079,177 or Stalker U.S. Pat. No. 2,678,537 which are related to the pumping art and in which the rotation of one rotor affects the rotation of another rotor. However, none of the art known to the inventor appears to be concerned with the problem of retireving wasted kinetic energy produced within a centrifugal pump of this invention.

Additionally, vanes are construced at the discharge end of the jacket to stop the remaining revolving column of water generated by the impeller. Generally, the use of vanes per se in order to retard the swirl of a liquid is known and is discussed, for instance, in Yates U.S. Pat. No. 2,361,521. However, the use of vanes in this particular type of centrifugal pump and in combination with a specially designed energy retrieving turbine appears to be new and significantly different.

SUMMARY OF THE INVENTION

Briefly, the invention comprises a centrifugal pump, preferably of the sort which includes an impeller for moving a relatively heavy meidum such as water against an operating head. In its simplest embodiment, the present invention includes a pump housing or jacket having at least one inlet and one outlet orifice. The pump jacket encases a medium driving impeller which is driven by a shaft extending through one end of the housing. A turbine at least partially surrounds the impeller in such a fashion as to retrieve the kinetic energy from the flow of water passing through the impeller. The turbine is mounted on a second shaft which likewise passes through the pump jacket. As water is pumped by the impeller it picks up kinetic energy and is accelerated tangentially as it moves out of the impeller. In a typical pumping system this kinetic energy may be lost or dissipated as heat. However, in the pumping system of the present invention this kinetic energy is retrieved by means of a turbine which converts at least part of the kinetic energy into useful energy that may be used to drive auxiliary stages or may be returned to boost the impeller power input. In this manner, the turbine also serves to slow down the swirl associated with the revolving column of water generated by the impeller. A set of flanges or vanes at the discharge end of the pumping jacket retards the swirl component of the stream of water and thereby improves the ability of the previously swirling stream of fluid to mix with the stream of fluid now departing through the discharge port. Additionally, the flanges help to avoid a drop in the operating pressure at the discharge of the jacket. The amount of the pressure drop would be equal to the centrifugal force of the column of water that was being moved back to its center of rotation. If the pressure at the discharge of the jacket were made less than the operating pressure of the head, pumping would cease even though the pressure at the periphery of the jacket was greater than the head. In other words, any curvilinear motion at the discharge end of the jacket reduces the ability of the pressure at the periphery of the jacket to move water from the jacket. Since all of the water that is replacing the water leaving the jacket moves along the periphery of the jacket, it is easy to see the need for these flanges.

It is therefore an object of the present invention to provide a centrifugal pump with a means for retrieving at least part of the kinetic energy generated by the impeller.

It is another object of the present invention to provide a centrifugal pump with an internal turbine which at least partially surrounds the impeller means for the purpose of retrieving at least some of the kinetic energy generated from the pumping medium.

It is a still further object of the present invention to provide a pump of the type just mentioned with a set of swirl-retarding vanes in order to induce a swirl-free discharge.

These and other objects and advantages of the invention will be more fully understood upon a reading of the following specification taken in view of the attached drawings.

BRIEF DESCRIPTION OF THE DRAWINGS

FIG. 5 is another embodiment of the present invention in which the output of the turbine section is mechanically connected to provide boosting power to an input auxiliary impeller;

FIG. 7 is a cross-sectional view of a portion of the pump shown in FIG. 6 as seen from perspective 7—7;

DETAILED DESCRIPTION

Figure 1:
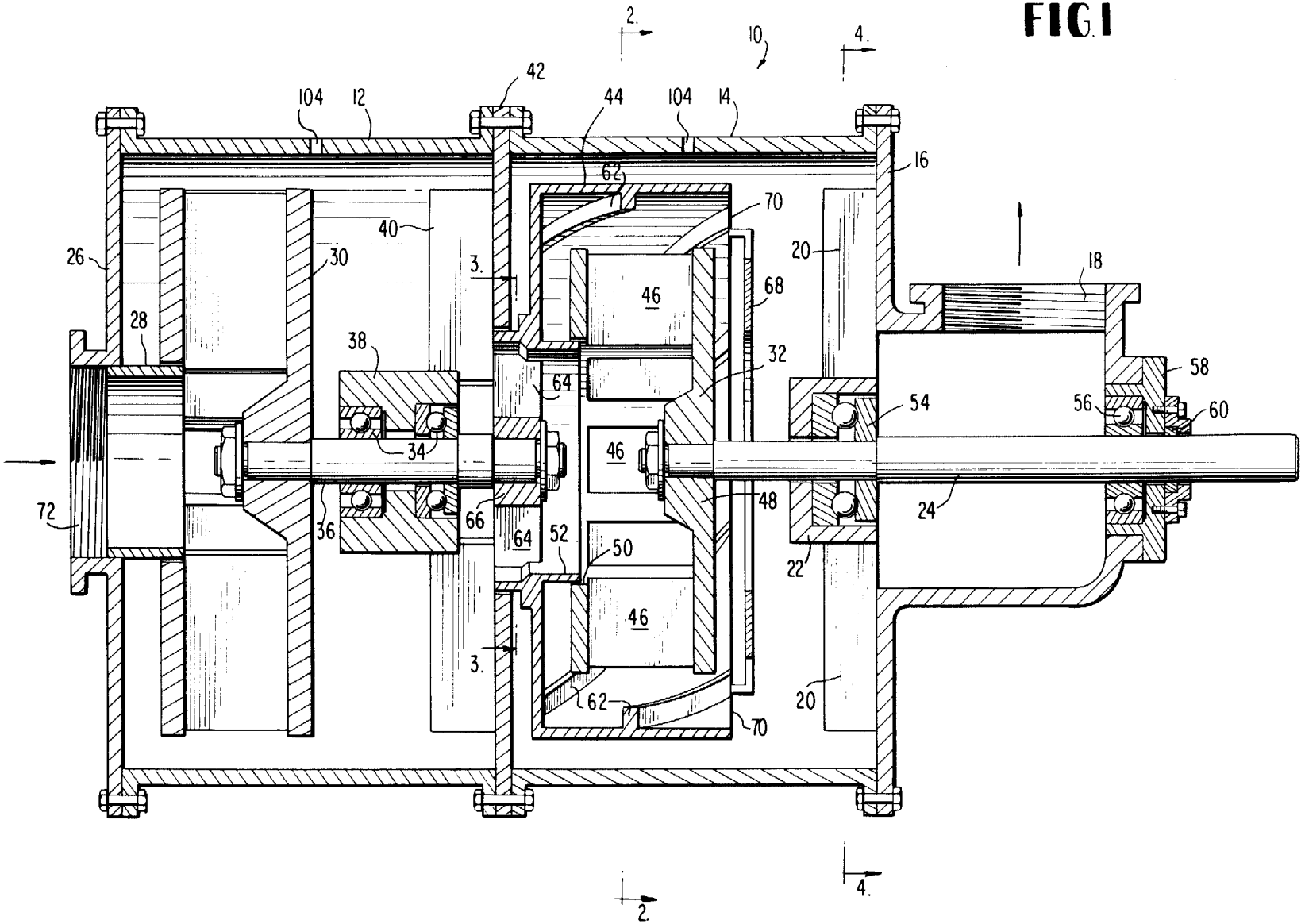
FIG. 1 is a partial cross-sectional view of a centrifugal pump according to a preferred embodiment of the present invention.

It will be understood during the following discussion that like reference numerals in different figures refer to similar elements throughout.

A pump 10 according to a preferred embodiment of the present invention is illustrated in FIG. 1. The pump mechanism is contained in a housing comprising two jacket sections 12 and 14. The discharge end of jacket 14 comprises a casting 16 including a discharge orifice 18. End casting 16 is bolted to jacket section 14. Also cast with end casting 16 is a plurality of discharge flanges or vanes 20. Casting 16 is designed to receive bearing housing 22 which, in turn, supports drive shaft 24.

At the suction end of the pump is another casting 26 bolted to auxiliary stage jacket 12. A stationary nipple 28 is attached to casting 26 and serves to direct water into the auxiliary impeller 30. Auxiliary impeller 30 is constructed with a hub and a plurality of radial channels extending outward therefrom in a manner similar to the construction of driven impeller 32 whose structure and function will be discussed later. Auxiliary impeller 30 is held in position by a pair of bearings 34 keyed to shaft 36. Bearing housing 38 and flanges 40 are cast as part of partition 42 which separates jacket sections 12 and 14. Housed inside of jacket section 14 is driven impeller 32 and turbine 44. It will be noted that turbine 44 substantially encloses the periphery of driven impeller 32.

The impeller 32 is formed with straight radial openings 46 which extend axially from a hub section 48. On the upstream side of impeller 32 is an opening 50 that forms a running fit over revolving nipple 52. Hub 48 is keyed to drive shaft 24. A suitable conventional source of rotary engine is applied to shaft 24 from a device not illustrated but known to those of ordinary skill in the art. Typically, drive shaft 24 would be driven by an internal combustion engine. Impeller 32 is held in place by a thrust bearing 34 situated within bearing housing 22 of end casting 16 as previously described. Shaft 24 is further secured from lateral movement by radial bearing 56 located near the shaft input point. Radial bearing 56 is housed within casting 58 which is bolted to end casting 16. Pump packing 60 is provided to prevent liquid from escaping around the periphery of drive shaft 24.

Turbine 44 is cast with a plurality of vanes 62 which are curved back from the direction of the curvilinear motion of the fluid along the outer periphery of the turbine wall. Turbine 44 also includes revolving nippel 52, divisions 64 and hub 48 as further shown in FIG. 3. Revolving nipple 52 forms a running fit located in the center of partition 42. The revolving nipple has two purposes. One purpose is to make an entrance for the water into impeller 32 and the other is to make a direct connection for power from turbine 44 to auxiliary input impeller 30. In other words, whenever turbine 44 revolves, auxiliary input impeller 30 will revolve also. The hub 66 is keyed to shaft 36 and since turbine 44 and auxiliary impeller 30 are keyed to the same shaft 36 they are free to run at the same rpm's regardless of the rpm speed of impeller 32. According to a preferred embodiment turbine 44 and impeller 30 are shown to be of the same diameter but it should be understood that this relationship may be altered according to the requirements of the situation. A thin plate collar 68 is fastened to turbine 44 and is situated on the downstream side thereof. Plate collar 68 has the purpose of keeping the water in the turbine from backing up, and some water bypasses the openings 70 shown in cross-sectional view 2. According to FIG. 2, turbine 44 is structured to run in a counterclockwise direction, therefore it is desirable that impeller 32 run in a counterclockwise direction also. However, because of the straight radial design of the openings 46 the impeller 32 could revolve in either direction depending upon the direction of rotation of drive shaft 24.

Figure 2:
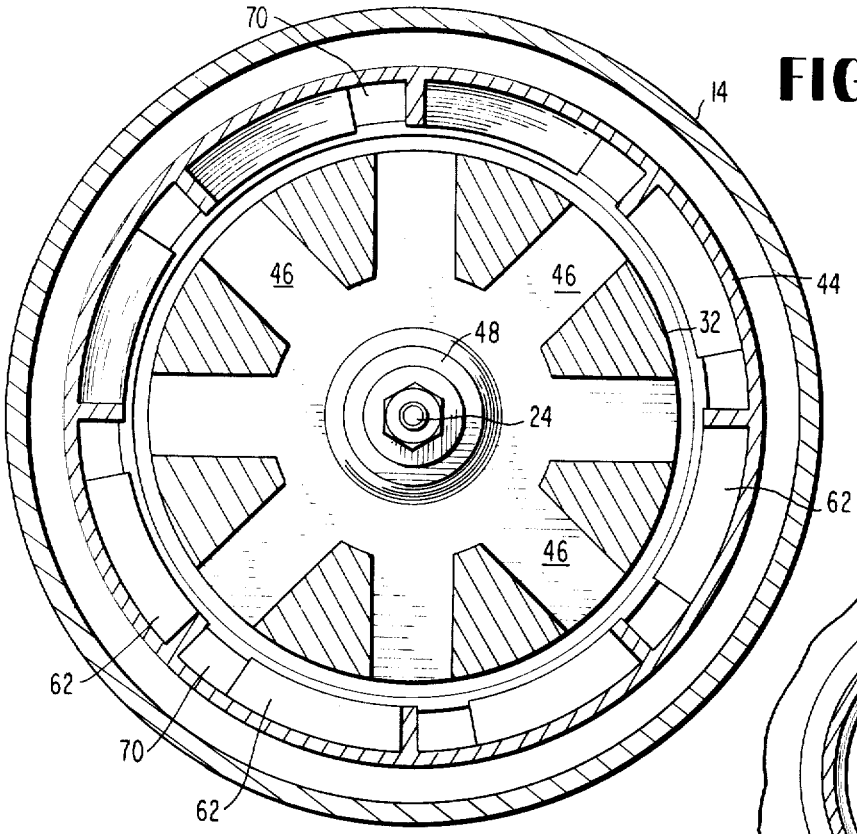
FIGS. 2, 3 and 4 are cross-sectional views taken from the planes indicated on FIG. 1.
Figure 3:
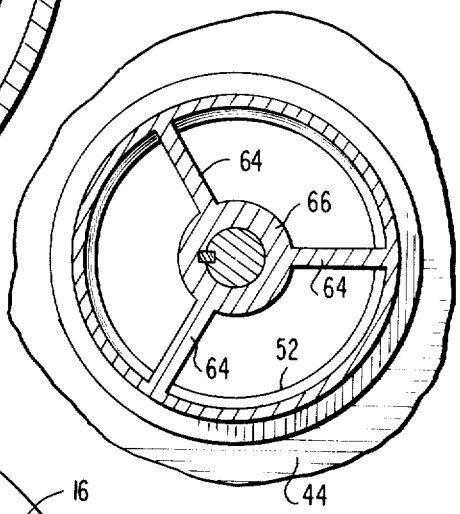
Figure 4:
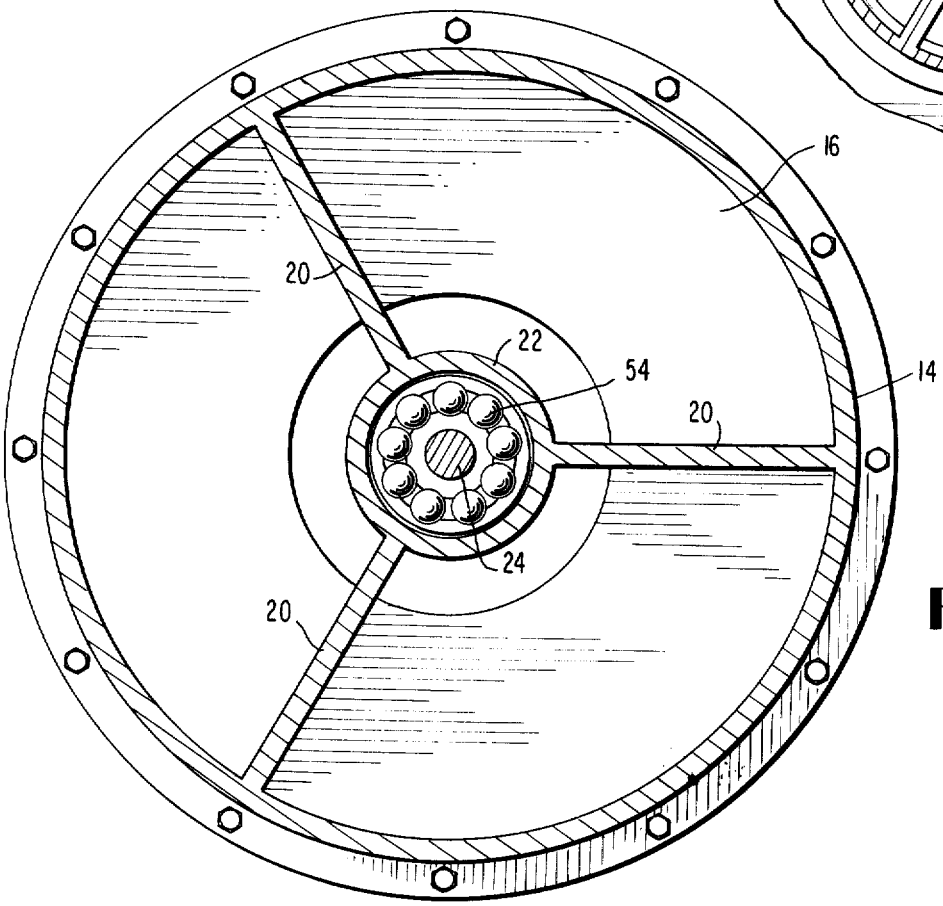

The cross-sectional views of FIGS. 2, 3 and 4 merely further illustrate the structural relationship discussed in relation to FIG. 1.

In operation, the centrifugal pump 10 is driven by an external source of conventional rotation engery, such as an interal combustion engine, as previously disclosed. Upstream input port 72 is connected to a source of liquid pumping medium such as a water reservoir or the like. Conversely, discharge port 74 is connected to a suitable water outlet. The operation can be simply explained by stating that as shaft 24 picks up speed impeller 32 accelerates and due to its centrifugal motion draws water through input ports 72 and expels that water radially outward through passageways 46. The water expelled by the impeller follows a curvilinear path which impinges upon vanes 62 of turbine 44. Since turbine 44 is directly connected to auxiliary input impeller 30 via shaft 36, some of the kinetic energy of the water discharged from impeller 32 is converted into rotaty motion that likewise drives auxiliary impeller 30. Because the curvilinear motion of the water exiting from impeller 32 does not contribute to the pumping head it would otherwise be lost and expended as waste energy in the form of heat. However, by using a surrounding turbine 44, it is possible to retrieve some of this energy which would otherwise be lost and convert it into useful energy. In this case, the energy that is retireved is converted into rotary power which is applied to an input booster stage thereby increasing the overall efficiency of the pump by adding a little more pumping power upstream. A more detailed explanation of the theory of this pump is as follows. Whatever a viscous medium such as a liquid or gas (hereinafter sometimes referred to as water for purpose of illustration) is accelerated by an impeller at right angles, against a centripetal force, it is caused to move in an expanding circle. Two equal energies are thereby produced: a potential energy which is a unit volume moved against a pressure head, and a kinetic energy not used to oppose the pressure head. In essence, the centrifugal force of the water accelerated by the impeller is used to balance the pressure in the surrounding jacket and is independent of the kinetic energy of the revolving water entering the jacket. The kinetic energy is generally not used to oppose the head as the water is discharged from the jacket.

According to a preferred embodiment of the present invention, the water leaving the impeller is caused to move along the periphery of the jacket perpendicular to the plane of curvilinear motion and then brought back to the center for discharge. It is essential that the curvilinear motion of the water be stopped before it is brought back to the center because the centrifugal force of this motion would oppose the pressure bringing the water back to the center. This curvilinear motion is stopped by the presence of flanges 20 located on casting 16. It is there where the revolving column of water rubs the non-revolving column of water and the interchange of particles therefore takes place with maximum efficiency and a minimum of turbulence.

Unfortunately, the kinetic energy of the revolving column of water does not otherwise contribute to the pressure of the pump necesssary to work against the pressure head. It is the inventor's discovery that the unused kinetic energy can be retrieved by a turbine revolving in the jacket and that the energy of the water may thereby be converted into useful rotational energy that may be applied to do other kinds of work. As shown in FIG. 1, the turbine may employ the unused kinetic energy to run an auxiliary stage. Alternatively, it can be applied to aid in the running of the impeller itself as shown in FIGS. 5 through 11. Of course, this energy may also be applied to a system outside of the pump.

Another embodiment of the present invention is shown in FIGS. 5 through 11. As stated previously, this embodiment differs from that of FIG. 1 in that the turbine converts the unused kinetic energy into additional power applied to the impeller itself. In distinction to this, the embodiment shown in FIGS. 1 through 4 applies the retrieved kinetic energy to an upstream booster stage instead. In reference to FIGS. 5 through 11, like numerals will be used to designate the same elements as were illustrated in FIGS. 1 through 4. FIG. 5 shows this new embodiment to include a pulley system 74 for transferring the energy developed by the turbine back to the impeller itself. By the judicious choice of pulleys it is possible to produce an input speed to the impeller that is greater than the input speed of the power source normally used to drive the impeller. This is important because of the rpm's delivered to the impeller by the turbine where less than the rpm's delivered by the conventional prime mover, then the turbine might tend to slow the impeller down. However, by making the rpm's of the turbine input greater than the rpm's of the normal input source, it is possible to produce a boosting effect. This mechanical advantage is obtained as illustrated by FIG. 5 by making turbine pulley 76 larger than pulley 78. Pulley 78 is connected via a shaft 80 to pulley 82. Pulley 82 is in turn connected via a V-belt drive to impeller pulley 84. Shaft 80 is supported by a pair of bearings 86 and further includes a pulley 88 to which initial power is applied to run the pumping system. In the manner described above, the kinetic energy retrieved by the turbine is delivered to the input impeller in the form of additional power.

Figure 6:
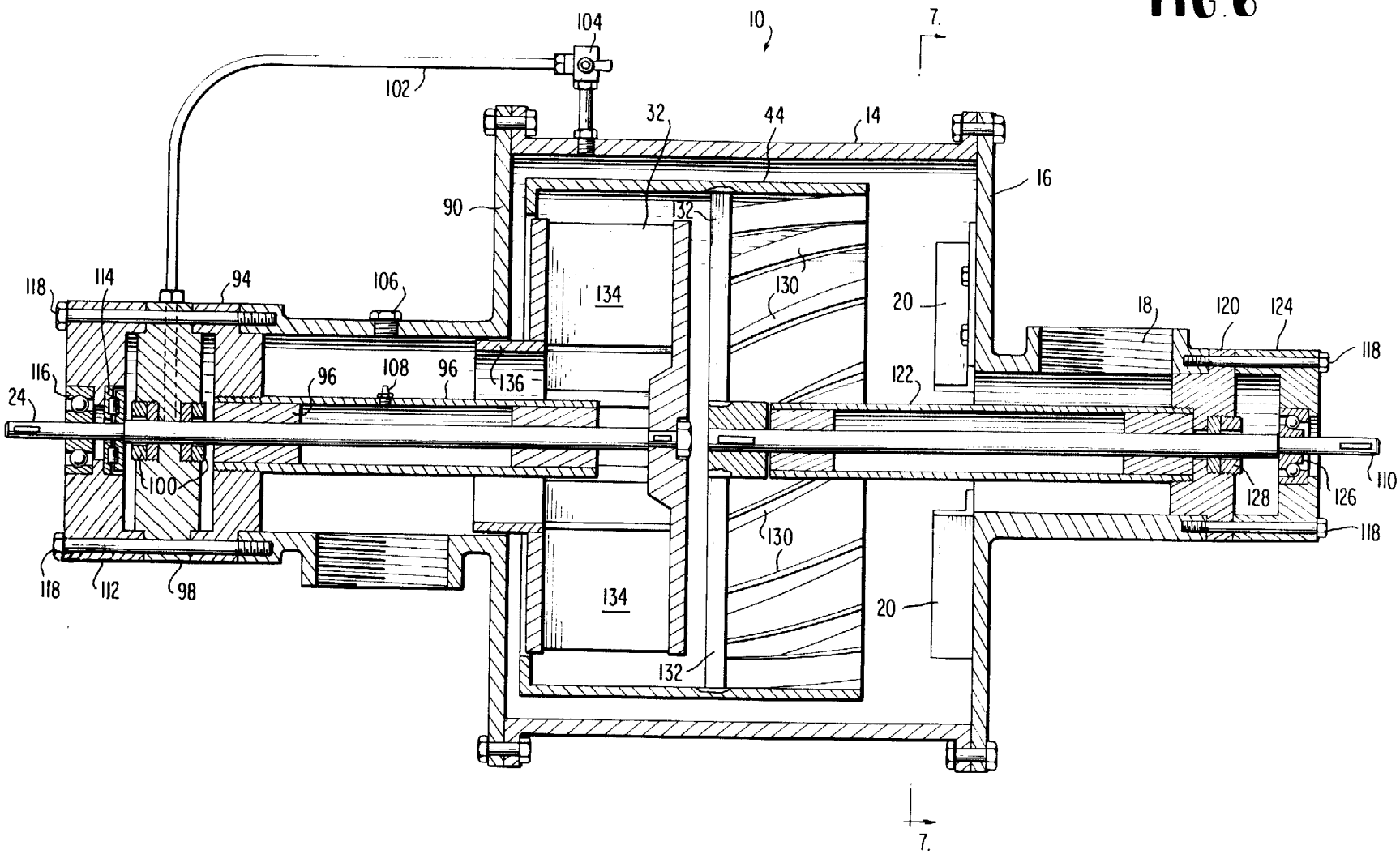
FIG. 6 is a partial cross-sectional view of the embodiment of FIG. 5 as seen from perspective 6—6.

The internal mechanism of the pump illustrated in FIG. 5 is shown in the cross-section at view 6—6 of FIG. 6. The pump jacket 14 may be constructed of flanged tubing, if so desired. The end plate 90 is cast and includes a means for supporting the impeller 32 which is keyed to input drive shaft 24. Drive shaft 24 is surrounded by an internal shaft housing 92 which is threadedly received in casting 94. Casting 94 also supports a shaft bearing 96. Because the impeller 32 is driven through a suction, a water seal is necessary to keep air from entering the input end. To provide this function, casting 98 is provided with packing nuts 100 which are designed to receive water from a tubing 102 connected to a vent priming valve 104. Shaft 24 may be greased by means of a removable plug 106 which opens directly above grease connection 108. Turbine shaft 110 may be greased in a similar manner. Casting 112 includes a thrust roller bearing 114 and a radial bearing 116. Stud bolts 118 are threadably received in the suction end casting 90 and serve to hold castings 94, 98 and 112 firmly in position thereby securing the movement of impeller 32. Additionally, rubber gaskets (not shown) may be employed between casting sections.

At the turbine end, end plate 16 is cast to include discharge 18 in a manner similar to that disclosed with reference to the previous embodiment. A casting 120 supports a shaft housing 122 in the same manner that shaft housing 92 is supported by casting 94. Another casting 124 houses bearing 126 which is a combination of thrust and radial bearing. A collar 128 is fastened to shaft 110 and provides additional support for the turbine due to the axial flow through it. Collar 128 is a packing nut and provides a rotary water seal. Castings 120 and 124 are held in position by a plurality of stud bolts 118 threadedly received in the discharge housing 16.

According to this particular embodiment, flanges 20 are bolted to end plate casting 16 as illustrated in perspective 7—7 and as shown in FIG. 7.

Figure 8:
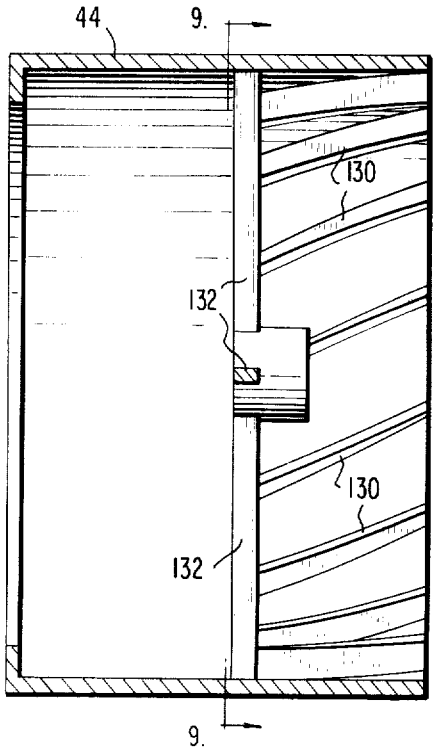
FIG. 8 is a partially sectional view of the turbine employed in the pump illustrated in FIG. 6.

The turbine of the second embodiment is of a slightly different configuration than that disclosed in the first embodiment. FIG. 8 is a view of the turbine of the second embodiment with portions cut away to better illustrate the curved configuration of vanes 130 which are cast into the periphery of the turbine and also into the spokes of the turbine 132.

Figure 9:
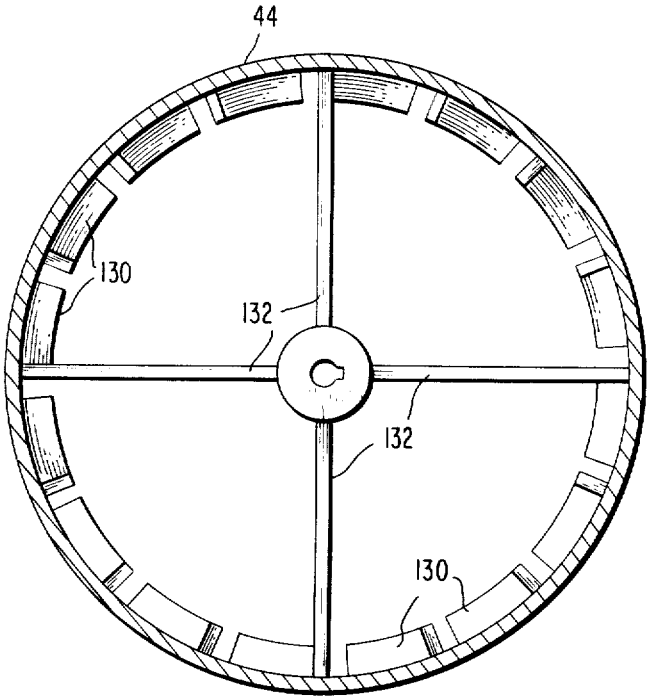
FIG. 9 is a cross-sectional view of the turbine of FIG. 8 as seen from the perspective of 9—9.

FIG. 9 is a cross-section of the turbine of FIG. 8 as seen from perspective 9—9 looking in the direction of the arrow indicated. This view is helpful in illustrating the open end construction of the turbine and the arrangement of spokes 132 and curved vanes 130 at the periphery of the turbine 44. While two specific turbine constructions have been disclosed it would be clear to those of ordinary skill in the art that various different other types can be employed as long as they efficiently retrieve the kinetic energy of the water as it is imparted to that medium by the impeller.

Figure 10:
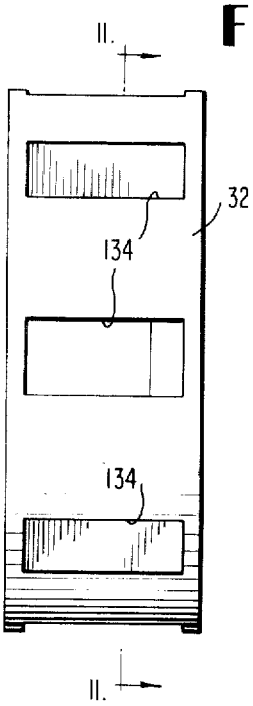
FIG. 10 is an elevated view of the impeller as employed in the centrifugal pump of FIG. 6.

FIG. 10 is a view of the impeller disclosing the straight radial slot construction 134. In general, the impeller 32 may be revolved in either a clockwise or counterclockwise direction. However, a preferred direction of rotation should be first determined so that the vanes 130 of turbine 44 can be correctly oriented in order to most efficiently retrieve the kinetic energy from the swirling water. Because radial openings in the impeller are straight water returning back through the impeller from the head will not cause the impeller to revolve or idle. It is desirable that the slots 134 be substantially straight and radiate directly from the center of rotation. The straighter the slots, the more efficiently the turbine may retrieve kinetic energy from the fluid medium.

Figure 11:
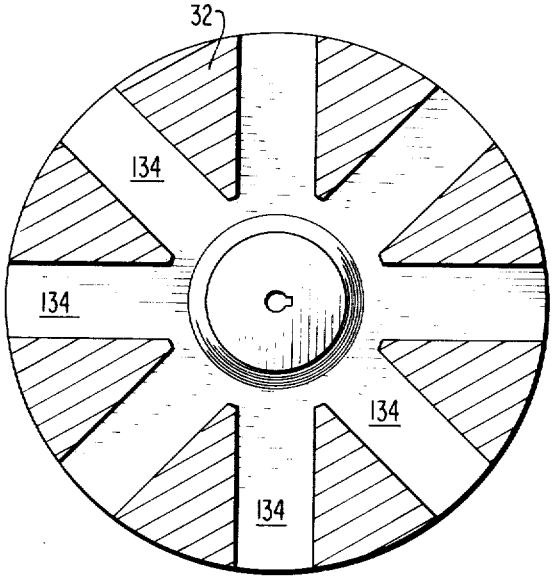
FIG. 11 is a cross-sectional view of the impeller of FIG. 10 as seen from the perspective 11—11.

FIG. 11 is a cross-sectional view of impeller 32 as seen from perspective 11—11 in FIG. 10. FIG. 11 clearly illustrates the straight radial opening construction of the impeller 32. It is generally desirable that the discharge area of the radial openings 134 be greater than the area of the intake nipple 136 as shown in FIG. 6. This construction allows for slower radial flow through the impeller.

The energy required to move the water in the slots 134 of the impeller 32 and into the jacket 14 containing the pressure of the operating head constitutes a potential energy equal to the work done by the pressure in the jacket to discharge an equal volume of fluid at the head. The work done to accelerate the tangential motion of the particles as they are moved radially through the impeller is also equal to the work done to move the particles radially against the pressure into the jacket. So the potential and kinetic energies are equal to the potential energy of the volume discharged at the head. The tangential motion of the water entering the jacket 14 remains revolving as it is moved toward the discharge perpendicular to the plane of the curvilinear motion and the energy of this motion is not needed further, as pumping is completed when the water enters the jacket from the impeller. It is the major object of the present invention to retrieve some of this unused kinetic energy by means of the turbine and to convert that energy into any kind of useful work that would not interfere with the operation of the pumping process per se. In the two disclosed embodiments, it has been shown that the kinetic energy retrieved from the fluid medium can be applied back to the pump itself in order to increase its pumping capacity and efficiency. However, it would be obvious to one of ordinary skill in the art to employ this retrieved kinetic energy for an application exterior to the pump if such an application were desired.

Additionally, it would be obvious to those of ordinary skill in the art that other types of turbines may be constructed which will retrieve kinetic energy from the impeller. Clearly, the vanes of the impeller could be modified according to methods well known to those of ordinary skill in the art. However, it is generally deemed desirable to keep radial slot openings 134 straight relative to the axis of rotation of the impeller. This construction permits the more efficient retrieval of kinetic energy by the turbine.

In a general manner, while there have been disclosed effective and efficient embodiments of the invention, it should be well understood that the invention is not limited to such embodiments, as there might be changes made in the arrangement, disposition, and form of the parts without departing from the principle of the present invention as comprehended within the scope of the accompanying claims.

I claim:

1. A system for pumping fluids comprising, a housing having a central inlet and a central outlet, an impeller mounted for rotation in said housing, said impeller having a peripheral surface and a plurality of radially extending slots therein extending from the center thereof to said peripheral surface, power means for rotating said impeller whereby the fluids are drawn in through said inlet and through said radially extending slots to said peripheral surface thereby imparting curvilinear and radial motion to said fluid, a plurality of radially extending fluid slowing guide vanes located on said housing near the fluid outlet, and means between said impeller and said vanes for retrieving the energy of said curvilinear motion, said radial motion forcing said fluid to said outlet, and said outlet being disposed axially downstream relative to said impeller.

2. The pumping system of claim 1 wherein said impeller includes a plurality of straight slot openings radiating directly from the center of axis of rotation of said impeller.

3. The pumping system of claim 1 further comprising an auxiliary impeller located upstream of said impeller dirven by said rotary power source, and wherein said useful power retrieved by said means is applied to said auxiliary impeller.

4. The pumping system of claim 1 wherein said useful power retrieved from said curvilinear energy is applied to said impeller to boost the power input thereto.

5. The pumping system of claim 1 wherein said useful power is applied to a device external to the pump itself.

6. A system for pumping fluids comprising, a housing having a central inlet and a central outlet, an impeller mounted for rotation in said housing, said impeller having a peripheral surface and a plurality of radially extending straight slots therein extending from the center thereof to said peripheral surface, power means for rotating said impeller whereby the fluids are drawn in through said inlet and through said radially extending straight slots to said peripheral surface thereby imparting curvilinear and radial motion to said fluid, a plurality of fluid slowing radially extending guide vanes located on said housing near the fluid outlet, and means between said impeller and said vanes for retrieving the energy of said curvilinear motion, said radial motion forcing said fluid to said outlet.

7. The pumping system of claim 6 further comprising an auxiliary impeller located upstream of said impeller driven by said rotary power source, and wherein said useful power retrieved by said means is applied to said auxiliary impeller.

8. The pumping system of claim 6 wherein said useful power retrieved from said curvilinear energy is applied to said impeller to boost the power input thereto.

* * * * *